US005319909A

United States Patent [19]

Singleterry

[11] Patent Number: 5,319,909

[45] Date of Patent: Jun. 14, 1994

[54] TOOL FOR LAP SIDING INSTALLATION

[76] Inventor: David S. Singleterry, 7646 SE. Pleasant Home Rd., Gresham, Oreg. 97080

[21] Appl. No.: 807,093

[22] Filed: Dec. 13, 1991

[51] Int. Cl.[5] ..... E04D 15/00

[52] U.S. Cl. ..... 52/749; 33/411; 33/640; 52/DIG. 1

[58] Field of Search ..... 52/749, DIG. 1, 547; 33/411, 533, 646, 647, 648

[56] References Cited

U.S. PATENT DOCUMENTS

| | | | |
|---|---|---|---|
| 248,460 | 10/1881 | Harris | 33/411 |
| 1,598,986 | 9/1926 | Ping . | |
| 3,463,480 | 8/1969 | Edstrom | 33/646 X |
| 4,155,175 | 5/1979 | Stiles | 33/187 |
| 4,425,714 | 6/1984 | Kelly, Jr. | 33/187 |
| 4,862,669 | 9/1989 | Jacobsen | 52/749 |

*Primary Examiner*—Carl D. Friedman
*Assistant Examiner*—Creighton Smith
*Attorney, Agent, or Firm*—Dellett and Walters

[57] ABSTRACT

A tool for lap siding installation includes a current board slot, a reference board slot and a lower surface, all three of which are disposed at an angle α from a reference surface at the top of the tool. The angle α corresponds to the angle between properly installed siding boards and the wall upon which they are installed. The current board slot has dimensions conforming to the dimensions of the siding being installed. The reference board slot is shorter than the current board slot by the amount of overlap that is desired between adjacent boards after the siding is installed. Optionally, a second set of these features with alternative dimensions can be disposed on the back of the tool making it suitable for use in installing a second type of siding when its orientation is reversed. To use the tool, a current board to be installed is lifted until it is close to its desired position and then fitted within the current board slot of the tool. The tool is then positioned against the wall so that a bottom of the reference slot fits against a reference board that has already been installed on the wall. When the reference surface is then brought into contact with the wall, the current board is properly positioned. A nail guide through the top of the tool allows the tool to be tacked into place in this position if one worker is working alone using two tools. If two workers are working in concert, no tacking is necessary and the current board can be nailed to the wall immediately.

8 Claims, 2 Drawing Sheets

TOOL FOR LAP SIDING INSTALLATION

BACKGROUND OF THE INVENTION

This invention relates to building construction tools, and more particularly to tools for the installation of lap siding.

Over the years a number of tools have been designed to assist in the process of installing lap siding. U.S. Pat. No. 1,598,986 to Ping for "Weatherboarding and Shingle Spacer" shows one such device. U.S. Pat. No. 4,862,669 to Jacobsen for "Alignment and Support Tool For Building Siding" shows another. Both of these devices have a member near their lowest point of contact with the wall that fits behind the board that they are using as their reference. In the Ping patent this member has the reference number 15, while in the Jacobsen patent this member bears the reference number 20. In any device with such a member, one board, the reference board for the board currently being installed above, is held apart from the board beneath it while the tool is in use. The tool must then be extricated from between these boards, which leaves a certain amount of looseness in the fit between them after the tool is removed. And, since the points where the reference board is nailed to the wall are now covered by the board that the tool was being used to install, there is no way to tighten the reference board by further driving those nails.

U.S. Pat. No. 4,155,175 to Stiles for "Siding Hanging Tool" shows a different sort of device, which does not suffer from the drawback described above. While this tool does not have a member that fits beneath the reference board, it instead has a member (5) that fits beneath the board that is currently being installed. When this tool is used, it is only used for the first part of a two step process. In that step the board being installed is positioned and tacked onto that location using the tool, and then the tool is removed so that the nails holding it can be driven in the rest of the way.

U.S. Pat. No. 4,425,714 to Kelly for a "Siding Board Installation Tool" shows another tool that must be used in a two step process if tight siding is to be obtained. As with the tool disclosed by Stiles, this tool is only used to position and tack the current board in place, then it must be removed so that final nailing can be completed. (FIG. 3 of the Kelly patent shows how loose the current board must be in order for the tool to be removed.)

SUMMARY OF THE INVENTION

It is an object of the present invention to provide a tool for the installation of lap siding that provides tight siding installation in a single step.

It is a further object of the present invention to provide a single lap siding installation tool that can be used with two different sizes of boards.

It is a further object of the present invention to provide a lap siding installation tool that can be used by a solitary worker, if so desired.

In accordance with the invention, there is provided a tool for lap siding installation that includes a current board slot, a reference board slot and a lower surface, all three of which are disposed at an angle $\alpha$ from a reference surface at the top of the tool. The angle $\alpha$ corresponds to the angle between properly installed siding boards and the wall upon which they are installed. The current board slot has dimensions conforming to the dimensions of the siding being installed. The reference board slot is shorter than the current board slot by the amount of overlap that is desired between adjacent boards after the siding is installed. Optionally, a second set of these features with alternative dimensions can be disposed on the back of the tool making it suitable for use in installing a second type of siding when its orientation is reversed. To use the tool, a current board to be installed is lifted until it is close to its desired position and then fitted within the current board slot of the tool. The tool is then positioned against the wall so that a bottom of the reference slot fits against a reference board that has already been installed on the wall. When the reference surface is then brought into contact with the wall, the current board is properly positioned. A nail guide through the top of the tool allows the tool to be tacked into place in this position if one worker is working alone using two tools. If two workers are working in concert, no tacking is necessary and the current board can be nailed to the wall immediately.

BRIEF DESCRIPTION OF THE DRAWINGS

For a better understanding of the invention, and to show how it may be carried into effect, further reference will be made, by way of example, to the accompanying drawings in which.

In the different figures of the drawings, like reference numerals designate like components, and primed reference numerals designate components that have similar functions to those designated by the corresponding unprimed reference numerals.

DETAILED DESCRIPTION

Figure 1:
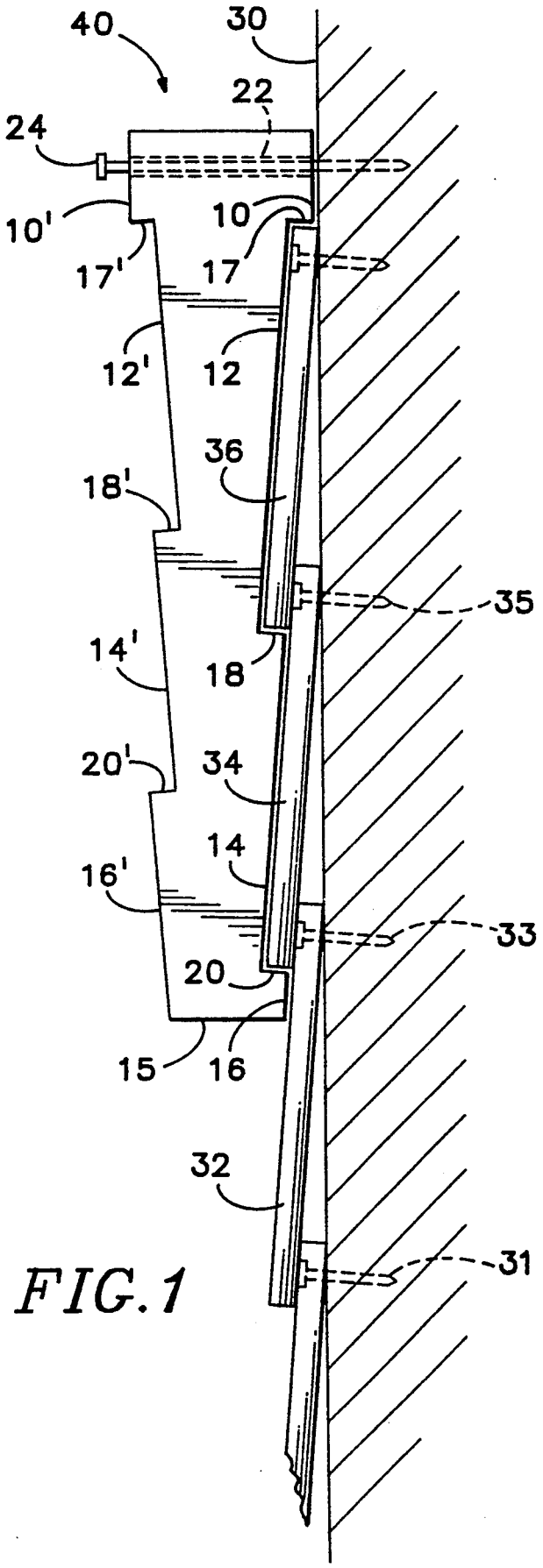
FIG. 1 is a profile view of the tool for lap siding installation according to the present invention in use.

Referring to FIG. 1, the tool 40 for lap siding installation according to the present invention is shown in use installing a current board 36 on a wall 30. Correct positioning of the current board 36 is achieved by the interaction of the tool 40 and a reference board 34. The tool 40 also contacts a bottom board 32 as part of this process. Please note that while, for clarity, spaces are shown between the tool 40 and the wall 30, the current board 36, the reference board 34 and the bottom board 32, in fact these surfaces are in contact when the tool 40 is in use.

The tool 40 has a reference surface 10 that abuts the wall 30 when the current board 36 is properly positioned. A current board slot 12 has dimensions that correspond to the width and thickness dimensions of the siding boards being used, and cradles the current board 36 as it is positioned against the wall 30. A reference board slot 14 is shorter than the current board slot 12 by the amount of desired overlap between adjacent boards. When the reference slot bottom 20 is brought into contact with the reference board 34 the current board 36 is properly positioned for installation. A lower surface 16 then rests against the bottom board 32. A nail 24 can be driven through a nail guide 22 near the top of the tool 40 and into the wall 30 to allow the tool 40 to be hung in place along one part of the wall 30 while a solitary worker uses another tool 40 to position a different part of the current board 36.

Figure 2:
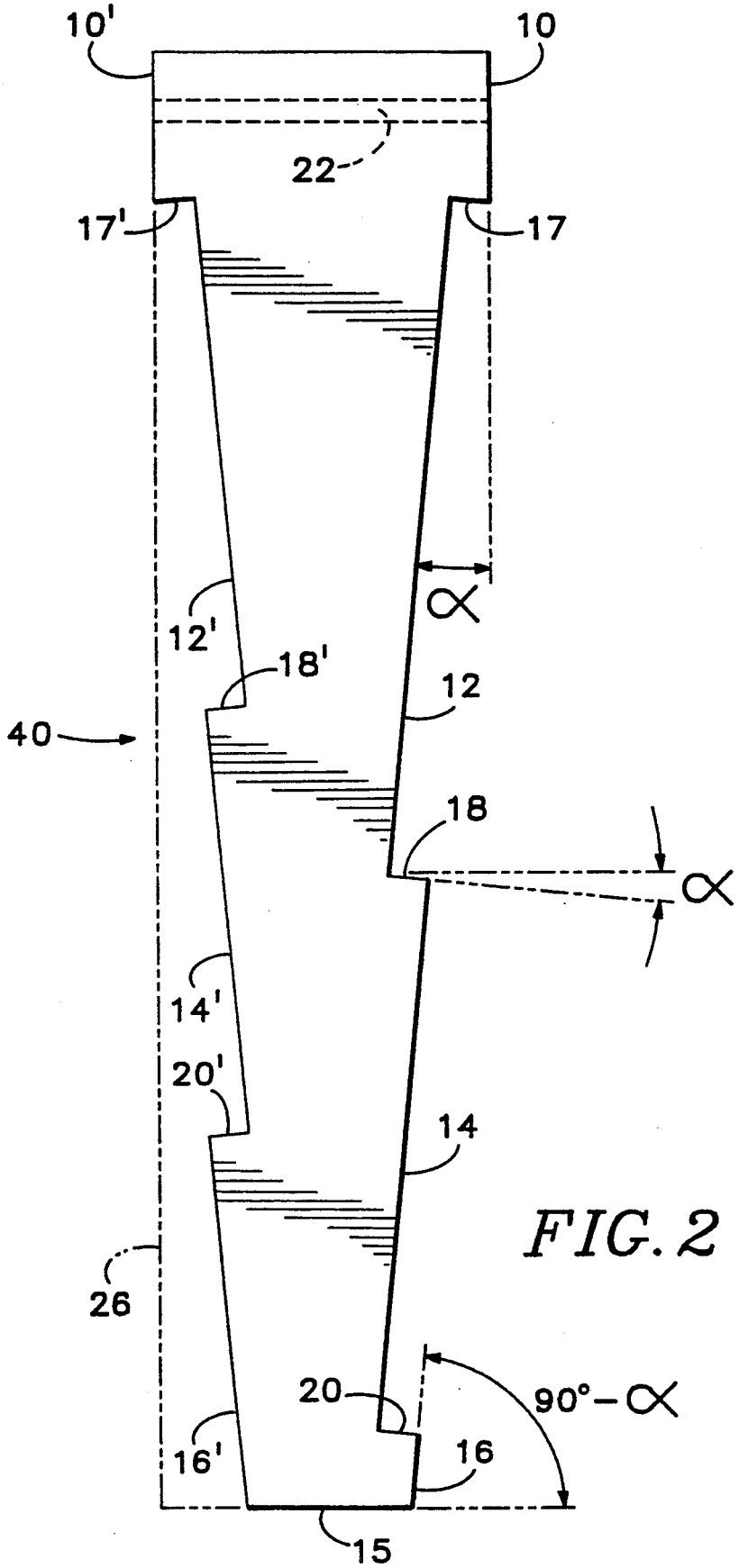
FIG. 2 is a larger profile view of the tool for lap siding installation according to the present invention showing how the angle between the siding to be installed and the wall is built into the tool.

Referring now to FIG. 2 as well as FIG. 1, the current board slot 12 is at an angle $\alpha$ from the reference surface 10, as is the reference board slot 14 and the lower surface 16. This angle $\alpha$ is the angle between properly installed lap siding boards and the wall upon which they are installed. The current slot top 17 and current slot bottom 18 are perpendicular to the inside surface of the current board slot 12, and therefore at the angle $\alpha$ from a (horizontal) line that is perpendicular to the reference surface 10. Similarly, reference slot bottom 20 is perpendicular to the inside surface of the reference board slot 14. The lower surface 16 is parallel to the inside surfaces of both the current board slot and the reference board slot 14, which means that it is also at angle o from the reference surface 10 and 90°-$\alpha$ from a line perpendicular to that surface, such as the bottom surface 15 of the tool 40.

The tool 40 is preferably constructed of a light, sturdy material such as wood or plastic, since the workers who use it will be lifting it, along with the siding that it is being used to install, many times every hour. The tool 40 may optionally include a nail guide 22 that allows a solitary worker using two or three of the tools 40 to install siding single-handedly. By tacking a current board 36 into position with a tool 40 located near its middle, the worker can then use another tool or tools 40 to position the ends.

The length, L, of the tool 40 is preferably made to be equivalent to the spacing between studs in the wall 30, so as to provide a convenient measuring rod for locating additional studs once one stud in the wall has been located.

The tool 40 is only shown in profile in FIGS. 1 and 2 because the third dimension, its thickness, is not very important to the invention. It is quite satisfactory for it to have a uniform thickness of one to three inches over its whole profile, although others might find it useful to provide indentations in the nature of grips in those regions of the tool 40 where workers find that they usually hold it.

In a preferred embodiment, the tool 40 is double sided having a second reference surface 10', a second current board slot 12', a second reference board slot 14' and a second lower surface 16' where the back 26 of a single-sided tool 40 would be. In this embodiment, the second slots 12' and 14' have dimensions that are appropriate to a second size of siding materials. And, if this second size of siding is to have a different angle to the wall when it is properly installed, the slots 12' and 14' will be a different angle $\alpha'$ to the reference surface 10'.

In one particular embodiment, suitable for either 8"×7/16" or 6"×⅜ siding, the top to bottom dimension of the first current board slot 12 is 8" and the top to bottom dimension of the second current board slot 12' is 6". The depths of these slots are 7/16" for the first current board slot 12 and ⅜" for the second current slot board 12', corresponding to the thickness of the boards. To provide a 1.5" overlap between adjacent boards on the first side, the first reference board slot 14 is 6.5" long. And to provide 1" of overlap between adjacent boards on the second side, the second reference board slot 14' is 5" long. For these dimensions, $\alpha$ is about 3.9° and $\alpha'$ is about 4.3°.

While a preferred embodiment of the present invention has been shown and described, it will be apparent to those skilled in the art that many changes and modifications may be made without departing from the invention in its broader aspects. For example, critical dimensions could be appropriate do very different types of sidings, but still employ the same basic principles. Or, the nail guide could be dispensed with and the top of the tool made very small, so that the reference surface was little more than a line or point, without departing from the same basic principles. The claims that follow are therefore intended to cover all such changes and modifications as fall within the true scope of the invention.

I claim:

1. A tool for lap siding installation, the tool comprising:

a first reference surface;

a first current board slot having dimensions approximately corresponding to cross-sectional width and thickness dimensions of siding boards to be installed, the first current board slot being adjacent to the first reference surface and at an angle $\alpha$ to the first reference surface, the angle $\alpha$ corresponding to a desired angle between the siding boards and a wall that the siding boards are to be installed upon; and a first reference board slot having a depth dimension approximately corresponding to a thickness of siding boards already installed and a width approximately corresponding to a width of siding boards already installed minus a desired overlap length between adjacent siding boards, the first reference board slot being more distant from the first reference surface than the first current board slot is and also being at the angle $\alpha$ to the first reference surface;

a second reference surface on an opposite side of the tool from the first reference surface;

a second current board slot having dimensions approximately corresponding to cross-sectional width and thickness dimensions of other siding boards to be installed, the second current board slot being adjacent to the second reference surface and at an angle $\alpha'$ to the second reference surface, the angle $\alpha'$ corresponding to a desired angle between the other siding boards and a wall that the other siding boards are to be installed upon; and a second reference board slot having a depth dimension approximately corresponding to a thickness of other siding boards already installed and a width approximately corresponding to a width of other siding boards already installed minus a desired overlap length between adjacent other siding boards, the second reference board slot being more distant from the second reference surface than the second current board slot is and also being at the angle $\alpha'$ to the second reference surface.

2. A tool according to claim 1 wherein the second current board slot comprises:

a second current slot top; and a second current slot bottom, with the second current slot top and second current slot bottom both being approximately perpendicular to the second current board slot.

3. A tool according to claim 1 wherein the second reference board slot comprises a second reference slot bottom that is approximately perpendicular to the second reference board slot.

4. A tool according to claim 1 further comprising a nail guide disposed approximately perpendicularly to the second reference surface.

5. A tool according to claim 1 wherein an overall length of the tool is equal to an expected spacing of studs in the wall.

6. A tool according to claim 1 wherein the angles $\alpha$ and $\alpha'$ are substantially unequal to one another.

7. A tool according to claim 1 further comprising a nail guide disposed approximately perpendicularly to the first reference surface.

8. A tool according to claim 1 further comprising a nail guide disposed approximately perpendicularly to both the first reference surface and the second reference surface.

* * * * *